US005231941A

United States Patent [19]

Wakayama

[11] Patent Number: 5,231,941

[45] Date of Patent: Aug. 3, 1993

[54] SEWING MACHINE WITH EMBROIDERY DEVICE

[75] Inventor: Akihiro Wakayama, Nagoya, Japan

[73] Assignee: Brother Kogyo Kabushiki Kaisha, Nagoya, Japan

[21] Appl. No.: 888,151

[22] Filed: May 26, 1992

[30] Foreign Application Priority Data

Aug. 24, 1991 [JP] Japan ..... 3-237005

[51] Int. Cl.[5] ..... D05B 21/00; D05C 9/04

[52] U.S. Cl. ..... 112/121.12; 112/103; 112/445

[58] Field of Search ..... 112/121.12, 121.11, 112/445, 457, 103, 78, 98

[56] References Cited

U.S. PATENT DOCUMENTS 4,301,753 11/1981 Meier ..... 112/445 X
4,480,561 11/1984 Makabe et al. ..... 112/445
4,869,184 9/1989 Hisatake et al. ..... 112/121.12
4,870,917 10/1989 Frye ..... 112/121.12
4,901,656 2/1990 Yoshida ..... 112/445 X
4,998,489 3/1991 Hisatake et al. ..... 112/103
5,074,229 12/1991 Sasako et al. ..... 112/121.12

FOREIGN PATENT DOCUMENTS 2-80084 3/1990 Japan .

*Primary Examiner*—Peter Nerbun
*Attorney, Agent, or Firm*—Oliff & Berridge

[57] ABSTRACT

Stitching data for embroidery patterns and identification data are stored in ROM of the embroidery ROM card. Stitching data for stitching patterns except embroidery patterns, such as figure patterns or point marks, are stored in ROM of another ROM card. If the card key is operated, it is determined whether the embroidery device is installed on the sewing machine or not, whether a ROM card is installed in the sewing machine or not, and whether the installed ROM card is a ROM card for embroidery or not. If at least either one of the embroidery device or a ROM card is not installed on the sewing machine, or the installed ROM card is not a ROM card for embroidery, warning is given to an operator.

20 Claims, 6 Drawing Sheets

SEWING MACHINE WITH EMBROIDERY DEVICE

BACKGROUND OF THE INVENTION

1. Field of the Invention

The present invention relates to a sewing machine with an embroidery device and, more particularly, with a sewing machine with an embroidery device capable of checking if both an embroidery device and a pattern card which stores embroidery stitching data, which are necessary for the embroidery, are installed on the main body of the sewing machine, and capable of warning if either one of them or both of them are not installed on the sewing machine.

2. Description of Related Art

Conventionally, an embroidery device mentioned below has been proposed which is capable of stitching practical patterns, such as a straight line and a zigzag line, and can be detachably installed on a free arm portion of the sewing machine so that comparatively large embroidery such as characters, design patterns, and figures can be stitched.

For example, Japanese Laid-Open Patent Publication NO. 2-80084 discloses an embroidery device as follows. The embroidery device is constructed so that an embroidery table can move in the cloth sending direction, the reverse direction of the cloth sending direction (Y direction), and X direction which is perpendicular with the Y direction. The embroidery device moves the embroidery table in the X direction by driving a first pulse motor by an X direction drive signal from the main body of the device. On the other hand, the device forms an embroidery pattern on the work fabric by driving a second pulse motor by a Y direction drive signal to move the embroidery table. The embroidery device is installed easily detachably on the main body.

A conventional sewing machine has pattern data for embroidery patterns, design patterns, and patterns such as a point mark stored in an external memory such as a ROM card for every kind of stitch pattern. In stitching the embroidery patterns, both the embroidery device and the ROM card for embroidery are installed on the main body. As mentioned above, the embroidery device and the ROM card are detachable from the main body of the prior sewing machine with an embroidery device. In stitching a practical pattern, the embroidery device and the ROM card are detached from the main body. In stitching an embroidery pattern, both the embroidery device and the ROM card are installed on the main body. However, in case of an inexperienced operator, although the operator may not install at least either one of an embroidery device or a ROM card for embroidery to stitch an embroidery pattern, yet the operator may drive the sewing machine motor by operating an embroidery start key. In this case, the problem arises that an embroidery pattern is not normally stitched even if the embroidery start key is operated.

SUMMARY OF THE INVENTION

It is an object of the present invention to provide a sewing machine with an embroidery device which detects incomplete installation of at least either one of the embroidery device or a pattern card in advance and activates a warning when the embroidery starts by using the embroidery device and a ROM card for embroidery in which embroidery stitching data are stored.

A sewing machine with an embroidery device of the present invention comprises an embroidery device being installed detachably on the main body of the sewing machine, a plurality of external memory means installed detachably and alternatively on the main body of the sewing machine and for storing stitching data of a plurality of stitching patterns, a detecting means for detecting if the embroidery device is installed on the sewing machine, a determining means for determining whether an external memory means is an external memory storing stitching patterns of embroidery or not, and warning means for giving warning to an operator in starting embroidery stitching based on the output from the detecting means and determining means in case of incomplete installation of at least either one of the embroidery device or the external memory means storing stitching patterns for embroidery.

As to the sewing machine with an embroidery device of the present invention, the detecting means detects if the embroidery deice is installed on the main body of the sewing machine or not, the determining means determines whether the external memory means installed in the main body of the sewing machine is an external memory means storing stitching patterns for embroidery or not. The warning means gives warning to an operator in starting embroidery stitching based on the output from the detecting means and determining means in case of incomplete installation of at least either one of the embroidery device or the external memory means storing stitching patterns for embroidery.

The detecting means, the determining means, and the warning means are installed on the sewing machine with an embroidery device of the present invention. If the installation of at least either one of the embroidery device or the external memory means storing stitching patterns for embroidery is not complete, warning is given to an operator when starting embroidery stitching. Therefore, it is possible to give warning to an operator in advance that the installation of at least either one of the embroidery device or the external memory means storing stitching patterns for embroidery is not complete.

DETAILED DESCRIPTION OF THE PREFERRED EMBODIMENTS

Hereafter, preferred embodiments of the present invention are explained based on the drawings.

The present invention is applied to an electronically controlled zigzag sewing machine with an embroidery device which has various embroidery patterns and which can be detachably installed on the sewing machine.

Figure 1:
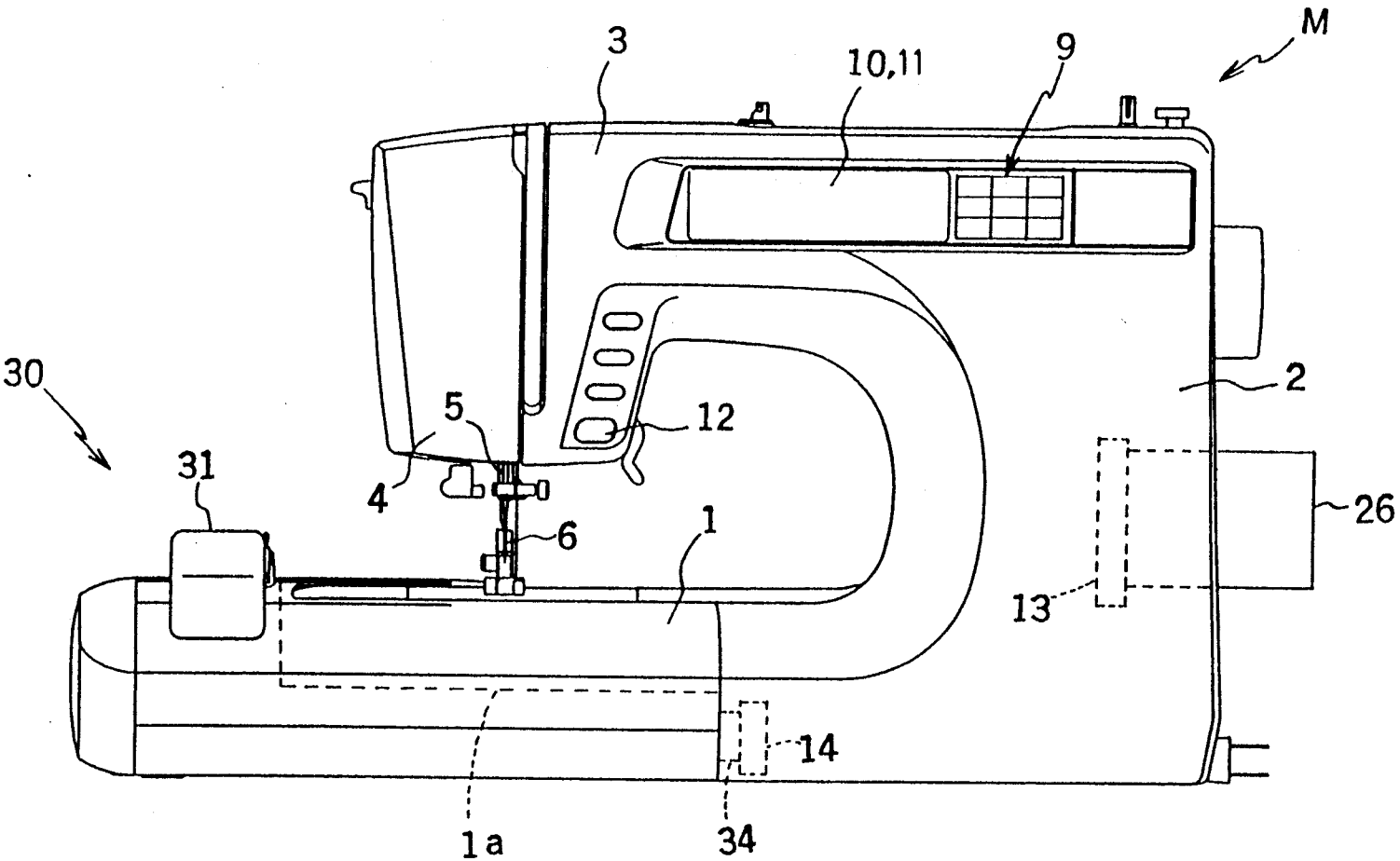
FIG. 1 is a front elevation of an electronically controlled zigzag sewing machine with the embroidery device according to the present invention.

As shown in FIG. 1, an electronically controlled zigzag sewing machine M comprises a bed portion 1, a standard 2 arising from the right hand of the bed portion 1, and an arm portion 3 overhanging the bed portion 1 to the left from the standard 2 with a head portion 4. A conventional feed dog up-and-down movement mechanism (not shown), which moves the feed dog up and down, and a conventional feed dog back-and-forth movement mechanism (not shown), which moves the feed dog back and forth, are installed on the bed portion 1.

A needle bar drive mechanism, a needle bar swing mechanism, and a balance drive mechanism (not shown), also all conventional, are installed on the arm portion 3. The needle bar drive mechanism moves a needle bar 5 up and down. A needle 6 is installed at the bottom end of the needle bar 5. The needle bar swing mechanism causes the needle bar 5 to swing in a direction perpendicular to the cloth sending direction. The balance drive mechanism (not shown) moves the balance up and down in accordance with the up and down movement of the needle bar. As shown schematically in FIG. 4, the dog feed up-and-down movement mechanism, the needle bar drive mechanism, and the balance drive mechanism are driven by the sewing machine motor 16. The feed dog back-and-forth movement mechanism is driven by a stepping motor of a feed dog drive 18. The needle bar swing mechanism is driven by a stepping motor of needle bar swing 17.

A large liquid crystal display 10 is disposed on the front side of the arm portion 3. Various stitch patterns, such as practical patterns and embroidery patterns, figures, such as shapes, and various messages are displayed on the display 10. Pattern selection keys (touch keys) 11 which are comprised of transparent electrodes are disposed on the front side of the display 10 corresponding to each display position of a plurality of stitch patterns. A desired stitch pattern can be selected by pressing a pattern selection key corresponding to the pattern on the display. A start and stop switch 12 which starts and stops stitching is installed on the head portion 4.

A card slot is formed on the standard 2 so that a ROM card (pattern card) in which pattern data of many stitch patterns, such as embroidery patterns, figure patterns, and point marks, are stored can be connected to a card connector 13 inside the card slot. In addition, a operation panel 9 is installed on the front side of the top portion of the standard 2. Nine function keys are installed on this operation panel 9. They are a practical stitching key to display practical patterns, a character stitching key to display character patterns, a card key to start embroidery pattern stitching, an internal memory key, an external memory key, a stitching key, a stitch method key, an explanation, and a using method key.

Figure 2:
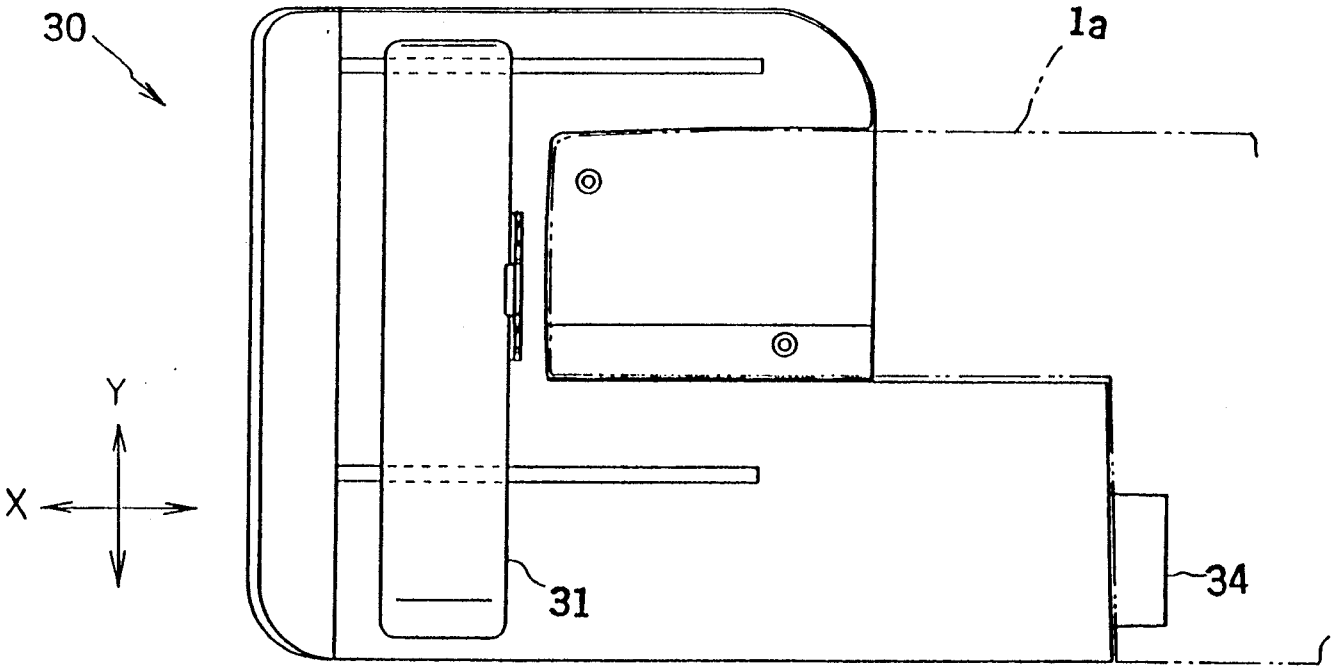
FIG. 2 is a plan view of the embroidery device of FIG. 1.
Figure 3:
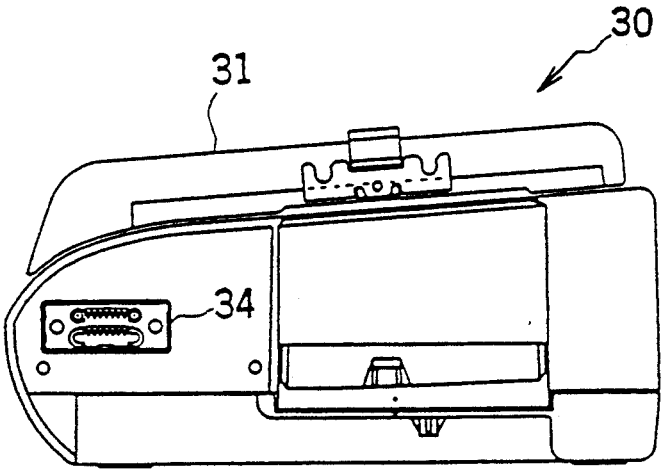
FIG. 3 is a side view of the embroidery device of FIG. 1.

A free arm portion 1*a* is formed on the left end part of the bed portion 1 as viewed in FIG. 1. An embroidery device 30 shown in FIGS. 1–3 is detachably installed on this free arm portion 1*a*. An embroidery table 31 is installed on the embroidery device 30 so that it can move in a cloth sending direction, a Y direction which is parallel with the reverse direction of the cloth sending direction, and an X direction which is perpendicular to the Y direction. A support frame (not shown) to support a work fabric is detachably installed on the embroidery table 31. An X direction stepping motor 32 (schematically shown in FIG. 5) to drive the embroidery table 31 in the X direction and a Y direction stepping motor 33 (schematically shown in FIG. 5) to drive the embroidery table 31 in the Y direction are installed in the main body frame of the embroidery device 30.

A connector 34 receives a drive signal to drive both stepping motors 32 and 33 through a connector 14 on the side of the sewing machine M and is disposed on the main body frame of the embroidery device 30. Therefore, various embroidery patterns can be formed on the work fabric on the support frame by the drive of both stepping motors 32 and 33 by the drive signal from the sewing machine M and the up and down movement of the needle bar 5.

Figure 4:
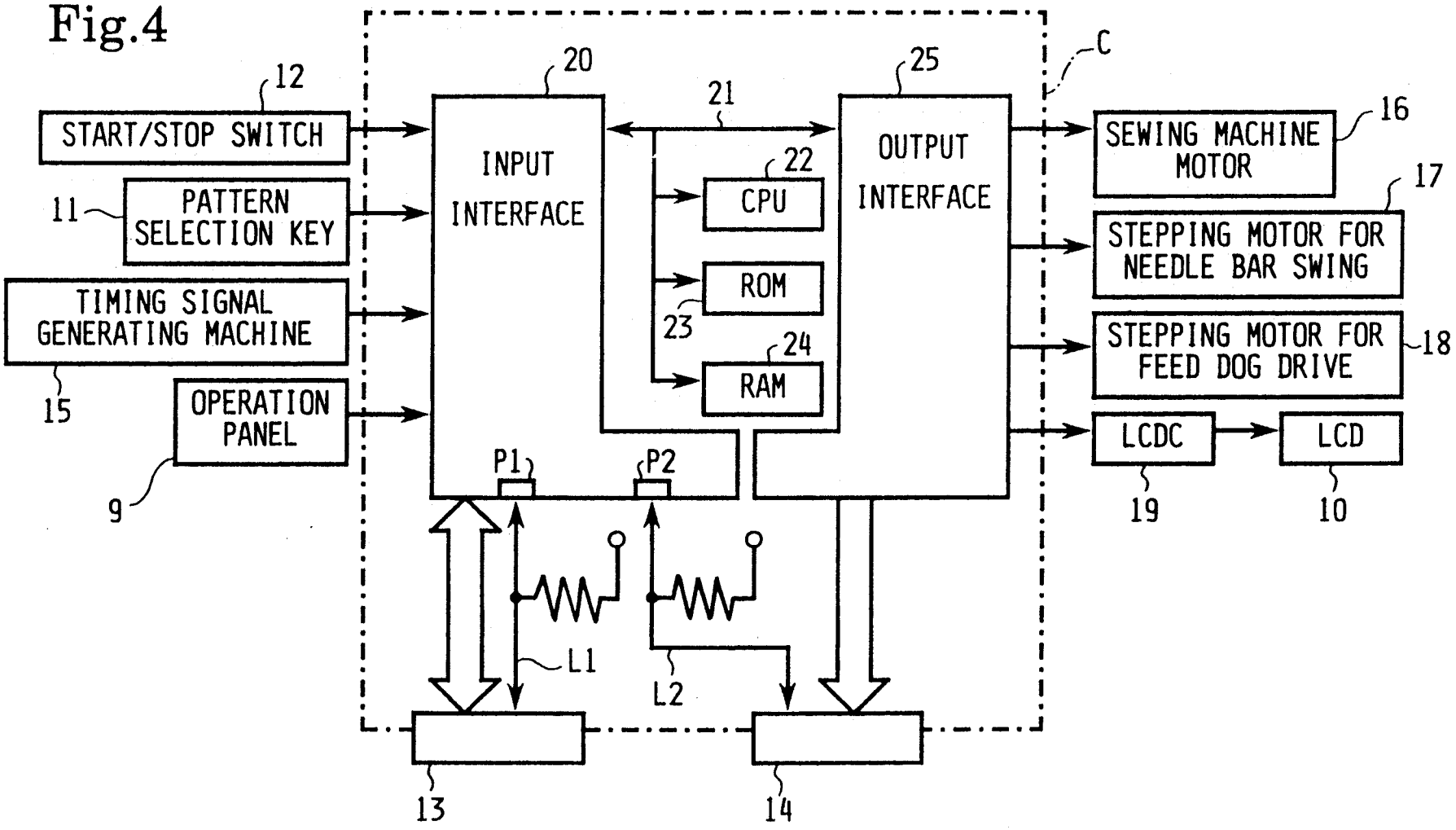
FIG. 4 is a block diagram of the control system of the electronically controlled zigzag sewing machine according to the present invention.

The outline of the control system of the sewing machine M is constructed as shown in the block diagram of FIG. 4.

The start and stop switch 12, the pattern selection key 11, the operation panel 9, and a timing signal generating machine 15 are connected to an input interface 20 of a control device C for the sewing machine M. The timing signal generating machine 15 is installed near the sewing machine main shaft which is rotated by the sewing machine motor 16 and generates various timing signals including the needle upper position, the needle lower position, and so on. The sewing machine motor 16, the stepping motor of needle bar swing 17, the stepping motor of feed dog drive 18, and the display controller (LCDC) 19 for the display (LCD) 10 are connected to an output interface 25 of the control device C.

The input port P1 of the input interface 20 is connected to, for example, the first pin of the card connector 13 through a connecting cord L1. The input port P2 of the input interface 20 is connected to, for example, the first pin of the connector 14 through a connecting cord L2. Since +5 V is supplied to each of the connecting cords L1 and L2, both of the input port P1 and P2 are constantly kept at a first state, for example a high or "H" level (refer to FIG. 5).

The control device C is comprised of CPU 22, the input interface 20, the output interface 25, ROM23, and RAM24, which are connected to CPU 22 through a bus such as data bus 21.

The drive control program to drive the motors 16–18 and the display control program to display the display data on the display 10 are stored in ROM 23. The control program of warning message display control to display various warning messages in stitching embroidery patterns, the display data of various messages to display during the control program, and a plurality of identification data which are the same as the identification data stored in each of many ROM cards 26 for embroidery are also stored in ROM 23. A pointer, a counter, or a buffer which temporarily store the operation result operated by CPU 22 are in RAM 24.

Figure 5:
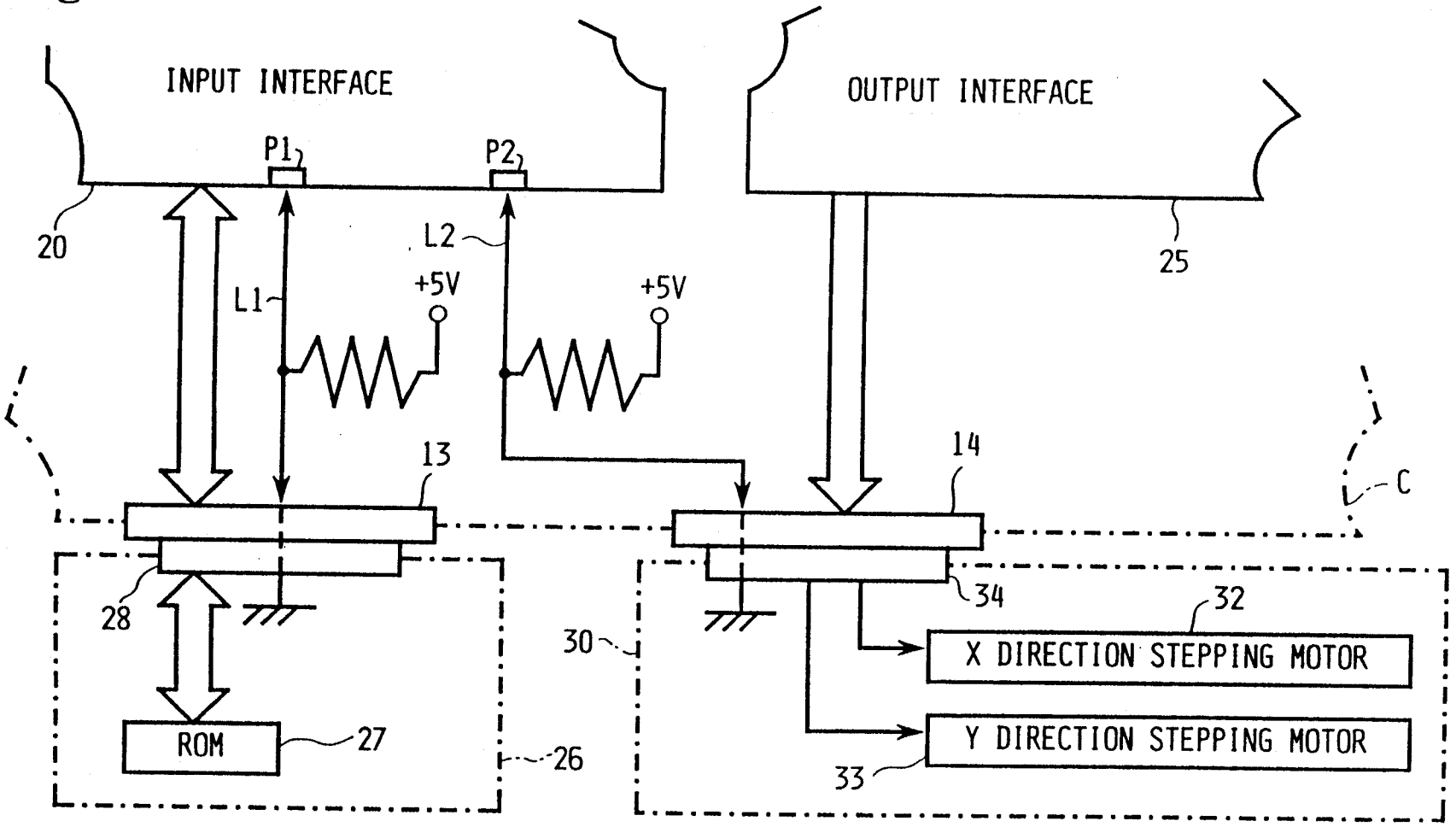
FIG. 5 is a block diagram of the control system of the sewing machine of the present invention when the embroidery device and the ROM card are installed.

The X direction stepping motor 32 and the Y direction stepping motor 33 are connected to the connector 34 of the embroidery device 30 as shown in FIG. 5. The first pin of the connector 34 is grounded. Therefore, when the embroidery device 30 is installed on the sewing machine M, because both connectors 14 and 34 are connected to each other, the first state or "H" level signal of the input port P2 is compulsorily changed to a second state, for example a low or "L" level.

There is a ROM card for embroidery patterns which stores stitching data of embroidery patterns, or a ROM card which stores stitching data of figure patterns or point marks for each kind of pattern. ROM 27 of the ROM cards 26 is connected to the connector 28 of these cards 26 and stores pattern data of many stitching patterns, the identification data of the ROM card 26, and the shape display data to display a shape of the stitching pattern. The first pin of the connector 28 is grounded. Therefore, when the ROM card 26 is installed in the sewing machine M, because both connectors 13 and 28 are connected to each other, the "H" level signal, for example, of the input port P1 is compulsorily changed to an "L" level, for example.

Figure 6:
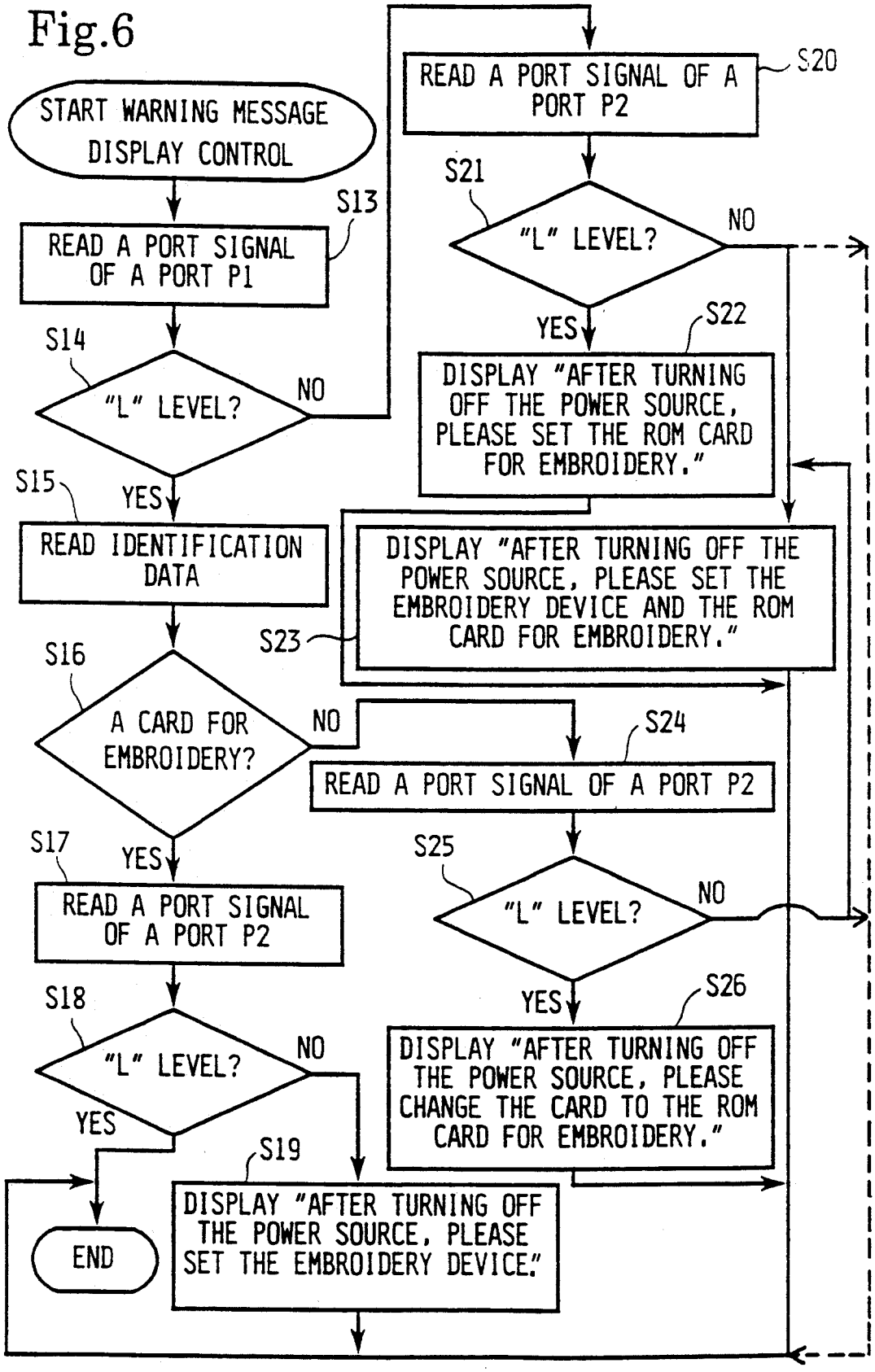
FIG. 6 is a flowchart of the routine of the warning message display control of the present invention.

The routine of the warning message display control according to a first embodiment of the control device of the sewing machine M is explained based on the flowchart of FIG. 6. Symbol Si(i=13,14,15 . . . ) indicates each step in the figure.

In this embodiment, when the card key of the operation panel 9 is operated to start the embroidery, the warning message display control starts. First, the port signal of the input port P1 is read (S13). When the port signal is "L" level, that is, the ROM card 26 is set in the sewing machine M (S14:Yes), the identification data are read from the ROM card 26 (S15).

When this identification data relates to embroidery patterns (S16:Yes), the port signal of the input port P2 is read (S17). When the port signal is "L" level, that is, the embroidery device 30 is installed on the sewing machine M (S18:Yes), the warning message display control ends. However, when the port signal is "H" level, that is, the embroidery device 30 is not installed on the sewing machine M (S18:No), a warning message "After turning off the power source, please set the embroidery device" appears on the display 10 (S19), and the warning message display control ends.

On the other hand, when the read identification data does not relate to embroidery patterns (S16:No), the port signal of the input port P2 is read (S24). When this port signal is "L" level (S25:Yes), a warning message "After turning off the power source, please set the ROM card for embroidery" appears on the display 10 (S26). However, when this port signal is "H" level (S25:No), a warning message "After turning off the power source, please set the embroidery device and the ROM card for embroidery" appears on the display 10 (S23).

When said read port signal of the input port Pl is "H" level (S14:No), the port signal of the input port P2 is read(S20). When this port signal is "L" level (S21:Yes), a warning message "After turning off the power source, please change the card to the ROM card for embroidery" appears on the display 10 (S22). However, when this port signal is "H" level (S21:No), a warning message "After turning off the power source, please set the embroidery device and the card for embroidery" appears on the display 10 (S23).

As explained above, in the case of incomplete installation of at least either one of the embroidery device 30 or the ROM card which stores stitching patterns for embroidery on the sewing machine M, a warning message to an operator appears on the display 10 in starting the embroidery stitching. Therefore, an embroidery stitching condition which is inadequate to start embroidery stitching can be warned in advance.

In addition to the display of the warning message, the warning buzzer can be applied in S19, S22, S23, and S26 of the warning message display control, and the drive circuit of the sewing machine motor 16 can be controlled so that it cannot be driven by operating the start and stop switch 12. Moreover, warning can be made by the synthesized sound or the blink of the warning lamp.

In a second embodiment, the warning message display control can be executed when the power source is turned on. However, in this embodiment as shown in dashed lines FIG. 6, in case of the answer NO in S21 and S25, and if the power source is just turned on, the warning message display control bypasses S23 for the pattern stitching and the practical stitching.

The sewing machine M can determine whether the ROM card 26 installed on the sewing machine M is a card for the embroidery patterns or not by the various elements. For instance, a projection part, slit, shape can be formed on the ROM card 26, or the position of the grounded pin out of a plurality of pins installed on the connector 28 of the ROM card 26 can be distinctive.

While advantageous embodiments have been chosen to illustrate the invention, it will be understood by those skilled in the art that various changes and modifications can be made therein without departing from the scope of the invention as defined in the appended claims.

What is claimed is:

1. A sewing machine with a main body and a detachable embroidery device comprising:

a plurality of external memory means for storing stitching data of a plurality of stitching patterns, installed alternatively and detachably on the main body of the sewing machine;

detecting means for detecting if said embroidery device is installed on the sewing machine;

determining means for determining whether the external memory means installed on the sewing machine is an external memory means storing stitching patterns for embroidery;

warning message means for warning an operator, said warning based on output from said detecting means and determining means upon incomplete installation of at least one of the embroidery device and the external memory means storing stitching data for embroidery.

2. The sewing machine according to claim 1, wherein said external memory means are pattern cards.

3.. The sewing machine according to claim 1, wherein said external memory means are ROM cards.

4. The sewing machine according to claim 1, wherein said external memory means are interchangeable pattern cards.

5. The sewing machine according to claim 1, wherein said warning means comprises a display means for displaying a message.

6. The sewing machine according to claim 1, wherein said warning means comprises a signal generating means for generating an audible signal.

7. The sewing machine according to claim 1, wherein said warning message means warns when embroidery stitching starts.

8. A sewing machine comprising:

first means for detachably connecting an embroidery device to said sewing machine;

second means for detachably connecting an external memory means for storing stitching data of a plurality of stitching patterns to said sewing machine;

detecting means for detecting whether an embroidery device is connected to said sewing machine;

determining means for determining whether an external memory means connected to said sewing machine has stitching patterns for embroidery stored therein; and warning means for warning an operator of an occurrence of at least one of two states, a first state occurring when said detecting means has detected that an embroidery device is not connected to said sewing machine and a second state occurring when said determining means has determined that an external memory means connected to said sewing machine does not have stitching patterns for embroidery stored therein.

9. The sewing machine according to claim 8, wherein said warning means comprises a display means for displaying a message.

10. The sewing machine according to claim 8, wherein said warning means comprises a signal generating means for generating an audible signal.

11. The sewing machine according to claim 8, wherein said first means for detachably connecting the embroidery device comprises a connector changeable from a first unconnected state to a second connected state.

12. The sewing machine according to claim 8, wherein said second means for detachably connecting the external memory means comprises a connector changeable from a first unconnected state to a second connected state.

13. The sewing machine according to claim 12, wherein said connector comprises a card slot.

14. The sewing machine according to claim 8, wherein said warning means detects said first and second states and issues a warning in response to one of said states.

15. A sewing machine having a detachable embroidery device removably coupled thereto and detachable memory means for storing stitching data of a plurality of stitching patterns removably coupled thereto, said sewing machine comprising:

embroidery detecting means for detecting whether said embroidery device is properly installed to said sewing machine;

memory detecting means for detecting whether said memory means is properly installed to said sewing machine; and warning means for warning an operator when said embroidery detecting means and said memory detecting means detects that at least one of said embroidery device and said detachable memory means is not properly installed to said sewing machine.

16. The sewing machine according to claim 15, wherein said detachable memory means is a ROM card.

17. The sewing machine according to claim 15, wherein said detachable memory means comprises a plurality of interchangeable pattern cards.

18. The sewing machine according to claim 15, wherein said warning means comprises a warning lamp which selectively turns on and off.

19. The sewing machine according to claim 15, wherein said warning means comprises a warning sound.

20. The sewing machine according to claim 15, further comprising an identification means for determining whether said detachable memory means has stitching patterns for embroidery stored therein when said detachable memory means is connected to said sewing machine, wherein said warning means warns when said identification means determines that said detachable memory means does not have stitching patterns for embroidery.

* * * * *